United States Patent [19]

Nemori et al.

[11] Patent Number: 4,596,766

[45] Date of Patent: Jun. 24, 1986

[54] SILVER HALIDE PHOTOGRAPHIC MATERIALS

[75] Inventors: Ryoichi Nemori; Hiroshi Kawasaki; Yasuo Mukunoki, all of Kanagawa, Japan

[73] Assignee: Fuji Photo Film Co., Ltd., Kanagawa, Japan

[21] Appl. No.: 658,742

[22] Filed: Oct. 9, 1984

[30] Foreign Application Priority Data

Oct. 7, 1983 [JP] Japan ..... 188230

[51] Int. Cl.[4] ..... G03C 1/78; G03C 1/96; G03C 1/38

[52] U.S. Cl. ..... 430/527; 430/528; 430/529; 430/637

[58] Field of Search ..... 430/637, 527, 529, 528, 430/631, 636

[56] References Cited

U.S. PATENT DOCUMENTS

| | | | |
|---|---|---|---|
| 3,514,293 | 5/1970 | Knox | 430/637 |
| 3,850,640 | 11/1974 | Babbitt et al. | 430/528 |
| 4,272,615 | 6/1981 | Yoneyama et al. | 430/527 |
| 4,272,616 | 6/1981 | Kishimoto | 430/529 |
| 4,367,283 | 1/1983 | Nakayama et al. | 430/637 |
| 4,495,275 | 1/1985 | Yokoyama et al. | 430/527 |
| 4,508,764 | 4/1985 | Zeldes | 430/637 |

*Primary Examiner*—Won H. Louie

*Attorney, Agent, or Firm*—Sughrue, Mion, Zinn, Macpeak and Seas

[57] ABSTRACT

A silver halide photographic material is disclosed comprising a support having thereon at least one layer containing a nonionic surface active agent having a polyoxyethylene group and a fluorine-containing compound, wherein the element composition of the surface of said layer has a ratio of $F_{1s}$ peak intensity/$C_{1s}$ peak intensity in the range of 0.3 to 2.0 when measured by an X-ray photoelectron spectrometry.

13 Claims, No Drawings

SILVER HALIDE PHOTOGRAPHIC MATERIALS

FIELD OF THE INVENTION

This invention relates to a silver halide photographic material and, more particularly to a silver halide photographic material having excellent antistatic properties.

BACKGROUND OF THE INVENTION

Since a photographic material is composed of a support having an electrically insulating property and photographic layers formed thereon, static charges frequently accumulate on the photographic material due to friction or peeling between the surfaces of the same kind of materials or different kinds of materials during the production of and use of the photographic material. The accumulated static charges cause various problems. For example, in the photographic film prior to development processing, the photographic silver halide emulsions layers are light-exposed by the discharge of the accumulated static charges to form spot-like, branch-like or feather-like stains upon developing the photographic film. These stains are a so-called static marks, which result in a great reduce of, or as the case may be, a complete loss of the quality or the commercial value of the photographic films. For example, it may be easily recognized that if such static marks appear in medical or industrial X-ray photographic films, etc., a misdiagnosis may result. Furthermore, these accumulated static charges cause the attaching of dust, etc., onto the surface of the support film for the photographic material. This results in inducing secondary problemsd such as unevenness in the coating step.

Such static charges are accumulated during the production steps or processing or using steps of the photographic materials as described above. The accumulation of the static charges occurs by the contact friction between the photographic film and a roll during the production step of the photographic film or the separation of the support of the photographic film and the silver halide emulsion layer thereof during the winding or rewinding step of the photographic film. Also, the accumulation of static charges occurs by the separation of the support surface and the emulsion surface of a photographic film in the case of rewinding the finished photographic film in such a high humidity that the photographic films adhere or, for example, the contact and separation between an X-ray photographic film and mechanical parts or an intensifying screen in an automatic photographing machine. The occurrence of the static marks of a photographic material cused by the accumulation of static charges in greater as the sensitivity of the photographic material is increased and the processing speed for the photographic material is increased.

It is considered that the friction electrification (triboelectricity) and the electrification by peeling off are caused by the ionic interaction between the molecules of the materials which are brought into contact but, it is difficult at present to sufficiently estimate structurally and chemically what kind of material is positively charged and what kind of material is negatively charged. However, the accumulation of such static charges is prevented by decreasing the amount of electrification or by increasing the electrical conductivity on the surface of the material to dismiss static charges in a very short period of time before the local discharging by the accumulation of static charges occurs. Thus, various methods of increasing the conductivity of the supports and various coated surface layers of photographic materials have been proposed and the utilizations of various kinds of hygroscopic materials and water-soluble inorganic salts as well as some kinds of surface active agents, polymers, have been attempted. For example, there are known the polymers as described in U.S. Pat. Nos. 2,882,157, 2,972,535, 3,062,785, 3,262,807, 3,514,291, 3,615,531, etc.; the surface active agents as described in British Patent 861,134; U.S. Pat. Nos. 2,982,651, 3,428,456, 3,457,076, 3,454,625, 3,552,972, 3,655,387; and zinc oxide, the semiconductors, colloid silica, as described in U.S. Pat. Nos. 3,062,700, 3,245,833, 3,525,621.

In particular, it is known that among the abovedescribed materials, nonionic surface active agents having one polyoxyethylene chain in one molecule have excellent antistatic properties.

According to the aforesaid techniques, it is possible to considerably restrain the accumulation of static charges by increasing the conductivity of the supports and the coated surface layers of the photographic materials but it is difficult to completely prevent the occurrence of static marks caused by the friction with various kinds of rollers or intesifying screens having different properties form those of the photographic materials.

On the other hand, it is known that the friction electrification and the peeling electrification of the supports and the coated layers of photographic materials can be reduced by using a fluorine-containing compound and the utilization of some kinds of surface active agents, polymers, etc., has been tried. Examples of such materials are the surface active agents as described in Japanese Patent Publication No. 43130/73, Japanese Patent Publication (Unexamined) No. 146248/82, and the polymers as described in Japanese Patent Publication (Unexamined) No. 78834/81. In this case, since the friction, contact, or peeling is a phenomenon relative to the surface of the photographic material, it is considered that the fluorine-containing compound contributing to change the amount of the electrification is the compound existing near the surface of the photographic material.

This is clear from the fact that even when a definite amount of a certain kind of a fluorine-containing surface active agent is incorporated in the coated surface layer of a photographic material, the amount of electrification of the photographic material greatly changes due to the influences of the coating and drying conditions for the photographic material, the nature of various additives used together, and the storing conditions for the photographic material.

Also, in the control of electrification by a fluorine-containing compound, the amount of electrification can be reduced when the material to which the photographic material is brought into contact or from which the photographic material is peeled off, is one kind of material. However, it is difficult to reduce the amount of electrification for each of any plural materials when the photographic material is brought into contact with the plural materials or is peeled off from the plural materials.

SUMMARY OF THE INVENTION

The object of this invention is to provide a photographic material which causes no static mark when used with various rubbers, nylon, metals, intensifying screens, etc.

As the result of various investigations, it has now been found that the above object can be attained by the photographic material of this invention as set forth below.

That is, according to this invention, there is provided a silver halide photographic material comprising a support having thereon at least one layer containing a nonionic surface active agent having a polyoxyethylene group and a fluorine-containing compound, wherein the element composition of the surface of said layer has a ratio of $F_{ls}$ peak intensity/$C_{ls}$ peak intensity in the range of from 0.3 to 2.0 when measured by an X-ray photoelectron spectrometry.

DETAILED DESCRIPTION OF THE INVENTION

In this invention, it is particularly preferred that the above-described ratio of $F_{ls}$ peak intensity/$C_{ls}$ peak intensity be in the range of 0.8 to 1.6.

The method of adjusting the amount of the fluorine-containing compound at the surface of a photographic material so as to fall the element composition of the surface determined by an X-ray photoelectron spectrometry in the aforesaid range is generally classified into the following two methods.

One of the methods is a method of further overcoating a coating liquid containing a fluorine-containing compound on a protective layer of a photographic material. In this case, the proportion of the fluorine-containing compound at the surface of the photographic material changes according to the amount of the fluorine-containing compound in the coating liquid for the overcoat and the difference in the diffusibility of the compound. Accordingly, in the case of employing an overcoat, the aforesaid method may be performed so that the element composition on the surface of the photographic material is in the above-described range considering the amount of the fluorine-containing compound and the diffusibility of the fluorine-containing compound.

Another method is a method of adding a fluorine-containing compound to the coating liquid for a protective layer, a silver halide emulsion layer or a backing layer. In this method, the following factors must be considered so that the element composition on the surface of the photographic material is in the above-described range.

(i) As the fluorine-containing compounds, a surface active agent or a polymer is preferably used. A surface active agent shows a stronger adhesive property for the surface of a photographic material than a polymer.

Also, among fluorine-containing surface active agents, anionic and cationic surface active agents show a stronger adhesive property than nonionic surface active agents or betaines.

(ii) The amount of the fluorine-containing compound on the surface of a photographic material changes almost in proportion to the amount of the fluorine-containing compound to be added to the coating liquid. In this case, if a fluorine-containing compound having a stronger adhesive property for the surface of a photographic material is used, the amount of the fluorine-containing compound existing in the surface of the photographic material is greatly increased with a small addition amount of the fluorine-containing compound, while if a fluorine-containing compound having a weak adhesive strength for the surface is used, the proportion of the fluorine-containing compound in the surface is less increased.

(iii) The amount of a fluorine-containing surface active agent depends upon the kind and an amount of compounds, in particular nonfluorine series surface active agents, added to the coating composition together with the fluorine-containing compound.

For example, if a nonfluorine series surface active agent having a strong adhesive property for the surface of a photographic material is used, the amount of the fluorine-containing surface active agent existing in the surface of the photographic material is reduced.

(iv) Drying condition: In a photographic material containing a fluorine-containing compound and a nonionic surface active agent having a polyoxyethylene group, the amount of the fluorine-containing compound existing in the surface thereof changes depending upon the drying condition after coating the coating liquid. Accordingly, when, for example, an anionic fluorine-containing surface active agent is used and a method of drying for 3 minutes is employed as a standard method, the amount of the fluorine-containing surface active agent existing in the surface of the photographic film is reduced if a method of drying for a time shorter than the aforesaid time is employed.

Now, examples of nonionic surface active agents which are used in this invention are the compounds represented by following general formula (I-1), (I-2) or (I-3):

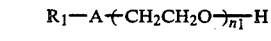

General Formula (I-1)

General Formula (I-2)

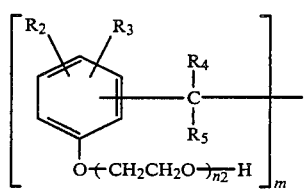

General Formula (I-3)

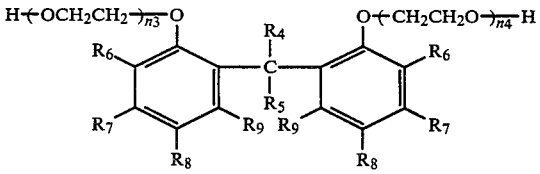

In the above formulae, $R_1$ represents an unsubstituted or substituted alkyl group having 1 to 30 carbon atoms, an unsubstituted or substituted alkenyl group or an unsubstituted or substituted aryl group: A represents —O— group, —S— group, —COO— group,

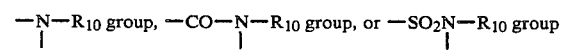

wherein $R_{10}$ represents a hydrogen atom or an unsubstituted or substituted alkyl group);

$R_2$, $R_3$, $R_7$, and $R_9$ each represents a hydrogen atom, an unsubstituted or substituted alkyl group, an aryl group, an alkoxy group, a halogen atom, an acyl group, an amido group, a sulfonamido group, a carbamoyl group, or a sulfamoyl group;

$R_6$ and $R_8$ each represents an unsubstituted or substituted alkyl group, an aryl group, an alkoxy group, a halogen atom, an acyl group, an amido group, a sulfonamido group, a carbamoyl group, or a sulfamoyl group;

the substituents for phenyl rings in the general formula (I-3) may not be symmetrical;

$R_4$ and $R_5$ each represents a hydrogen atom, an unsubstituted or substituted alkyl group or an aryl group;

said $R_4$ and $R_5$, said $R_6$ and $R_7$, and said $R_8$ and $R_9$ may combine with each other to form an unsubstituted or substituted ring;

$n_1$, $n_2$, $n_3$, and $n_4$ each is a mean polymerization degree of ethylene oxide and is a number of 2 to 50; and m is a mean polymerization degree and is a number of 2 to 50.

Preferred examples of the nonionic surface active agents represented by the above-described general formulae for use in this invention are shown hereinbelow.

That is, $R_1$ in general formula (I-1) preferably represents an alkyl group having 4 to 24 carbon atoms, an alkenyl group, or an alkylaryl group, and particularly preferably is a hexyl group, a dodecyl group, an isostearyl group, an oleyl group, a t-butylphenyl group, a 2,4-di-t-butylphenyl group, a 2,4-di-t-pentylphenyl group, a p-dodecylphenyl group, a m-pentadecaphenyl group, a t-octylphenyl group, a 2,4-dinonylphenyl group, an octylnaphthyl group.

Preferred examples of $R_2$, $R_3$, $R_6$, $R_7$, $R_8$, and $R_9$ are an unsubstituted or substituted alkyl group having 1 to 20 carbon atoms such as a methyl group, an ethyl group, an i-propyl group, a t-butyl group, a t-amyl grup, a t-hexyl group, a t-octyl group, a nonyl group, a decyl group, a dodecyl group, a trichloromethyl group, a tribromomethyl group, a 1-phenylethyl group, a 2-phenyl-2-propyl group; an unsubstituted or substituted aryl group such as a phenyl group, a p-chlorophenyl group; an unsubstituted or substituted alkoxy group shown by $-OR_{11}$ (wherein $R_{11}$ represents an unsubstituted or substituted alkyl group having 1 to 20 carbon atoms or an aryl group); a halogen atom such as a chlorine atom, a bromine atom; an acyl group shown by $-COR_{11}$ (wherein $R_{11}$ has the same meaning as defined above); an amido group shown by $-NR_{12}COR_{11}$ (wherein $R_{11}$ has the same meaning as defined above and $R_{12}$ represents a hydrogen atom or an alkyl group having 1 to 20 carbon atoms); a sulfonamido group shown by $-NR_{12}SO_2R_{11}$ (wherein $R_{11}$ and $R_{12}$ have the same meaning as defined above); a carbamoyl group shown by

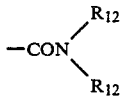

wherein, $R_{12}$ has the same meaning as defined above); or a sulfamoyl group shown by

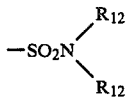

(wherein, $R_{12}$ has the same meaning as defined above); and said $R_2$, $R_3$, $R_7$, and $R_9$ may be a hydrogen atom. In these cases, $R_6$ and $R_8$ are preferably an alkyl group or a halogen atom, more preferably a bulky tertiary alkyl group such as a t-butyl group, a t-amyl group, a t-octyl group, and $R_7$ and $R_9$ are particularly preferably a hydrogen atom. This is, the compound of general formula (I-3) prepared from a 2,4-di-substituted phenol is particularly preferable.

Preferred examples of $R_4$ and $R_5$ are a hydrogen atom, an unsubstituted or substituted alkyl group such as a methyl group, an ethyl group, an n-propyl group, an i-propyl group, an n-heptyl group, a l-ethylamyl group, an n-undecyl group, a trichloromethyl group, a tribromomethyl group; an unsubstituted or substituted aryl group such as an α-furyl group, a phenyl group, a naphthyl group, a p-chlorophenyl group, a p-methoxyphenyl group, a m-nitrophenyl group. Also, said $R_4$ and $R_5$, said $R_6$ and $R_7$ and said $R_8$ and $R_9$ may combine with each other to form an unsubstituted or substituted ring such as a cyclohexyl ring. Particularly preferred examples of $R_4$ and $R_5$ are an alkyl group having 1 to 8 carbon atoms, a phenyl group, or a furyl group. Also, $n_1$, $n_2$, $n_3$, and $n_4$ are particularly preferably a number of 5 to 30, and said $n_3$ and $n_4$ may be the same or different.

These compounds are described in, for example, U.S. Pat. Nos. 2,982,651, 3,428,456, 3,457,076, 3,454,625, 3,552,972, and 3,655,387; Japanese Patent Publication No. 9610/76; Japanese Patent Publication (Unexamined) Nos. 29715/78 and 89626/79; Japanese Patent Publication (Unexamined) Nos. 203435/83 and 208743/83; Hiroshi Horiguchi, *Shin Kaimen Kasseizai*, published by Sankyo Shuppan, 1975.

Examples of the nonionic surface active agents which are preferably used in this invention are illustrated below:

Compound Example:

$C_{11}H_{23}COO(CH_2CH_2O)_8H$ I-1

$C_{15}H_{31}COO(CH_2CH_2O)_{15}H$ I-2

$C_{17}H_{33}COO(CH_2CH_2O)_{15}H$ I-3

$C_8H_{17}O(CH_2CH_2O)_7H$ I-4

$C_{12}H_{25}O(CH_2CH_2O)_{10}H$ I-5

$C_{16}H_{33}O(CH_2CH_2O)_{12}H$ I-6

$C_{18}H_{35}O(CH_2CH_2O)_{16}H$ I-7

$C_{22}H_{45}O(CH_2CH_2O)_{25}H$ I-8

I-9

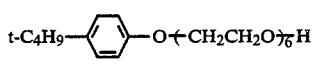

I-10

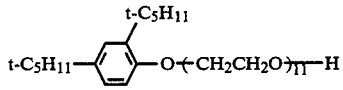

I-11

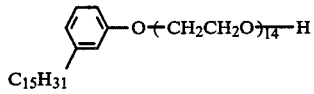

I-12

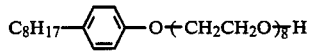

I-13

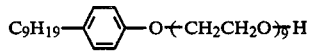

-continued
Compound Example:
I-14
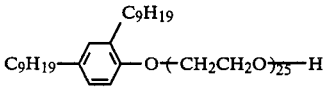
I-15
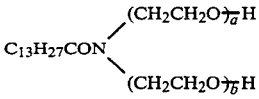
a + b = 15
I-16
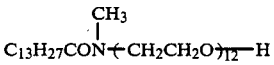
I-17
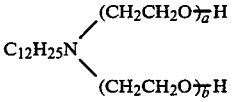
a + b = 20
I-18
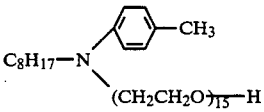
I-19
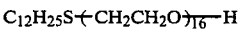
I-20
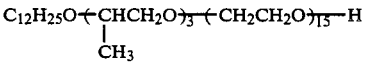
I-21
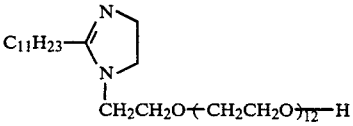
I-22
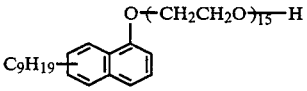
I-23
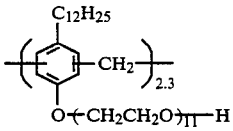
I-24
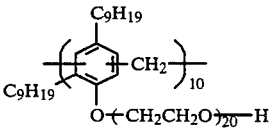
I-25
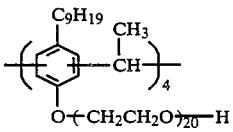
I-26
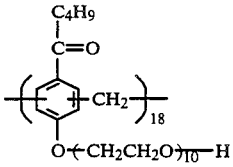
-continued
Compound Example:
I-27
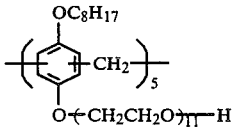
I-28
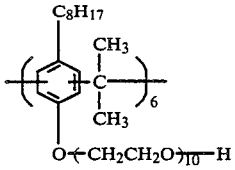
I-29
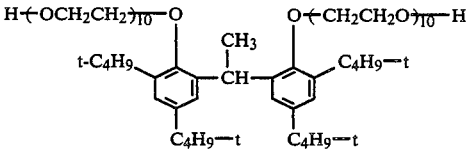
I-30
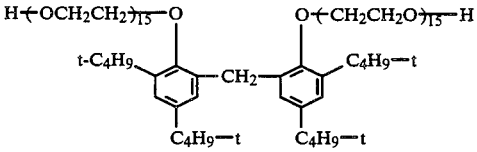
I-31
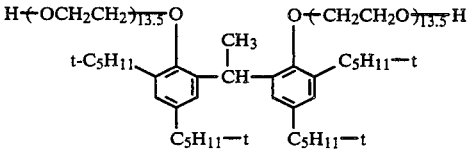
I-32
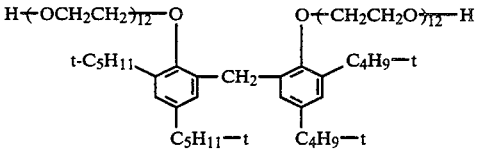
I-33
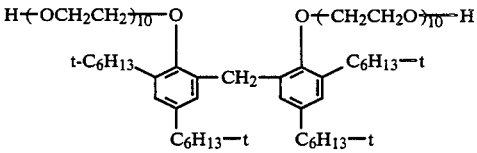
I-34
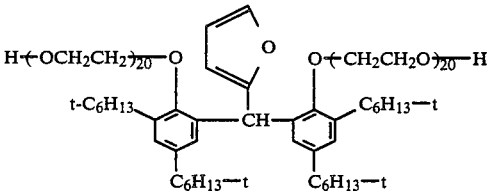
I-35
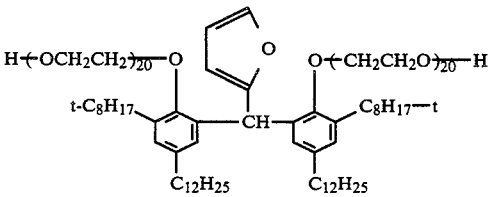

-continued
Compound Example:
I-36
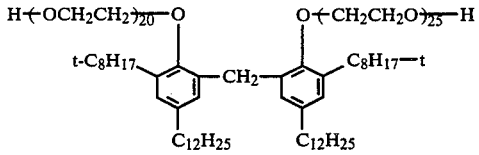
I-37
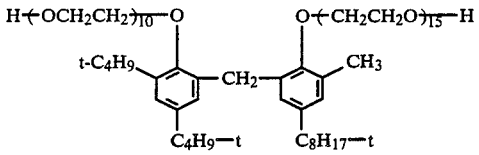
I-38
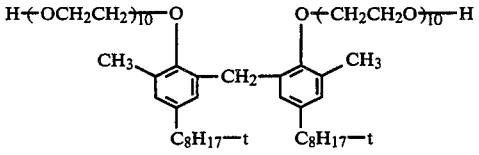
I-39
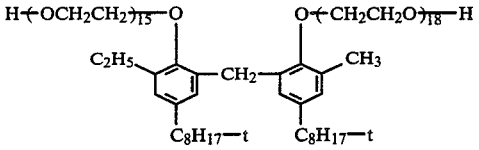
I-40
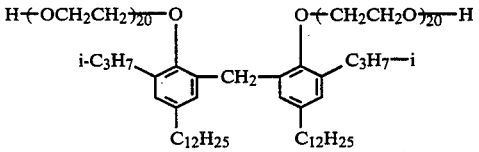
I-41
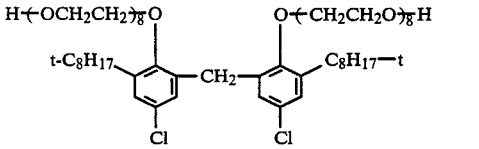
I-42
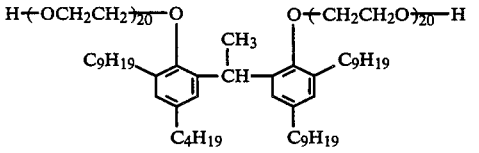
I-43
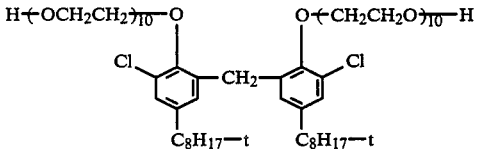
I-44
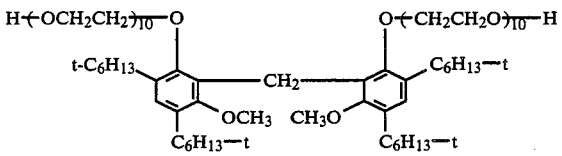
-continued
Compound Example:
I-45
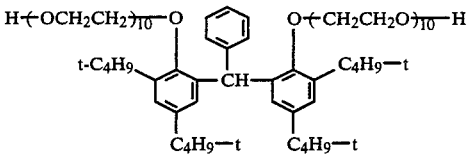
I-46
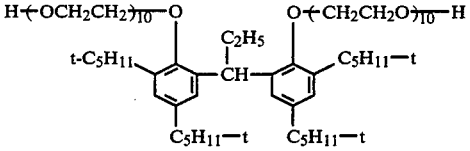
I-47
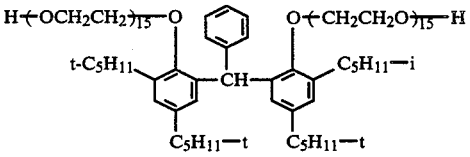
I-48
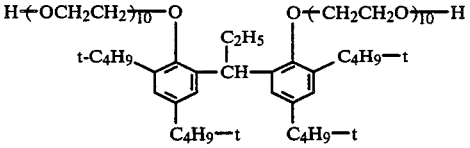
I-49
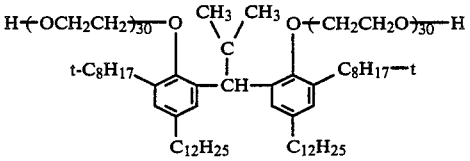
I-50
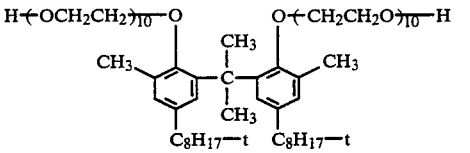
I-51
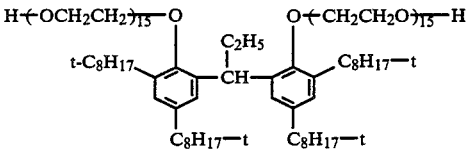
I-52
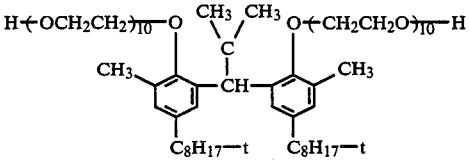
I-53
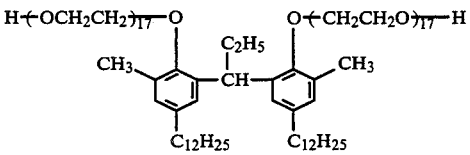

-continued

Compound Example:

I-54

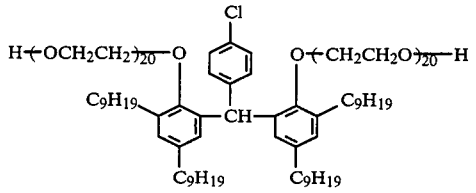

I-55

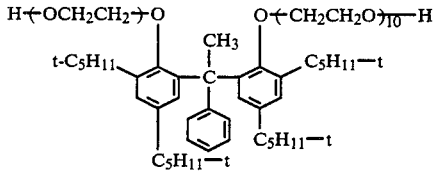

I-56

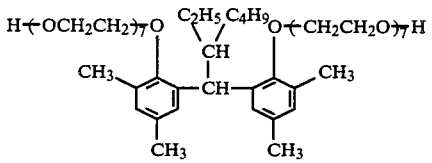

I-57

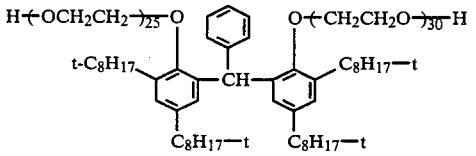

I-58

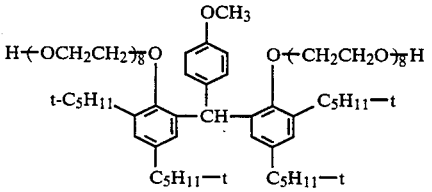

I-59

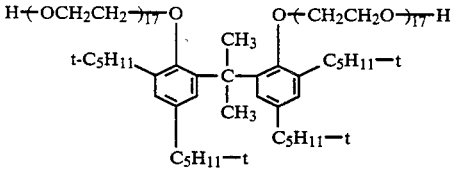

I-60

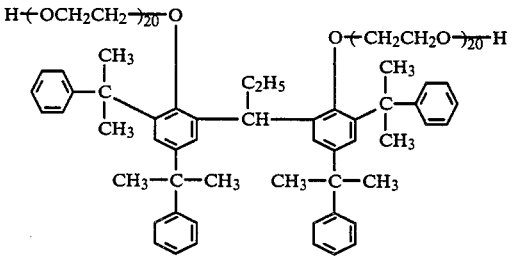

I-61

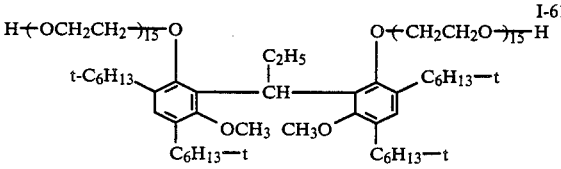

-continued

Compound Example:

I-62

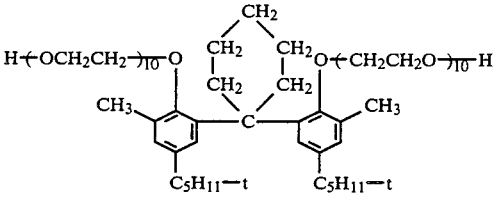

I-63

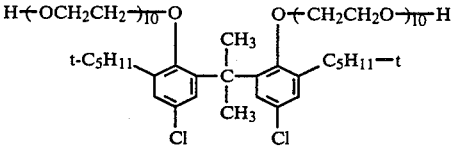

I-64

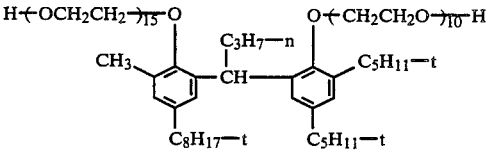

I-65

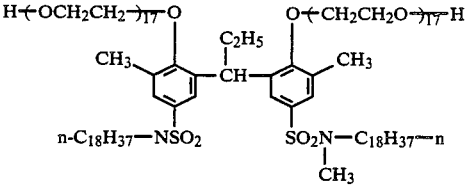

I-66

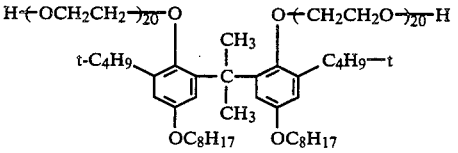

I-67

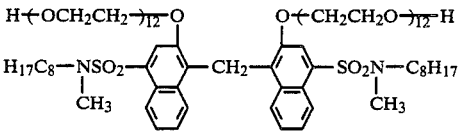

I-68

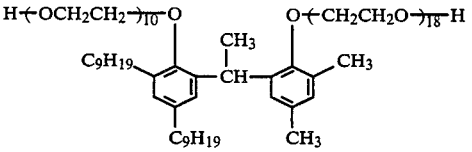

The amount of the nonionic surface active agent shown by general formula (I-1), (I-2), or (I-3) for use in this invention is preferably 5 to 500 mg, more preferably 10 to 300 mg per square meter of the photographic material.

The fluorine-containing compound which is used in this invention is a compound containing at least three fluorine atoms and may be a surface active agent or a polymer. The compound may contain a nonionic, anionic, cationic or bentaine series fuctional group as a hydrophilic group.

Examples of the fluorine-containing compounds which are used in this invention are the fluorine-containing surface active agents described in, for example, British Pat. Nos. 1,293,189 and 1,259,398; U.S. Pat. Nos.

3,589,906, 3,666,478, 3,754,924, 3,775,236;, 3,850,640; Japanese Patent Publication (Unexamined) Nos. 48520/79, 114944/81, 161236/75, 151127/76, 59025/75, 113221/75, and 99525/75; Japanese Patent Publication Nos. 43130/73, 6577/82; Japanese Patent Publication (Unexamined) Nos. 200235/83 and 196544/83; Japanese Patent Publication (Unexamined) Nos. 84712/78 and 64228/82; *I & EC Product Research and Development*, 1(3), (1962, 9); *Yu Kagaku*, 12(12), 653–662 (1963); and the fluorine-containing polymers described in, for example, Japanese Patent Publication (Unexamined) Nos. 158222/79 and 129520/77; Japanese Patent Publication No. 23828/74; British Pat. Nos. 1,352,975 and 1,497,256; U.S. Pat. Nos. 4,087,394, 4,016,125, 3,240,604, 3,679,411, 3,340,216 and 3,632,534; Japanese Patent Publication (Unexamined) Nos. 30940/73 and 129520/77; U.S. Pat. No. 3,753,716.

Particularly preferred fluorine-containing compounds are fluorine-containing surface active agents represented by the following general formula (II):

General Formula (II)

$$Rf—B—X$$

wherein Rf represents a partially or wholly fluorinated unsubstituted or substituted alkyl, alkenyl or aryl group containing at least three fluorine atoms; B represents a divalent linkage group; and X represents a water solubilizing group.

In the above formula, B is preferably an alkyl group, an aryl group or an alkylaryl group, which may be a divalent unsubstituted or substituted linkage group interrupted by a different kind of atom or group such as oxygen, an ester group, an amido group, a sulfonyl group, and sulfur.

In the above formula, X is a hydrophilic group such as, for example, a nonionic group shown by the polyoxyalkylene group of $—D\text{-}O)_{n_5}R_{13}$ (wherein D represents $—CH_2CH_2—$, $—CH_2—CH_2—CH_2—$, or $$—CH_2—\underset{\underset{OH}{|}}{CH}—CH_2—;$$

$n_5$ represents a mean polymerization degree of the polyalkylene group and is a number of 1 to 50; and $R_{13}$ represents an unsubstituted or substituted alkyl or aryl group); a hydrophilic betaine group such as $$—\overset{\overset{R_{14}}{|}}{\overset{\oplus}{N}}—\underset{\underset{R_{15}}{|}}{}Alk—COO^{\ominus} \text{ and } —\overset{\overset{R_{14}}{|}}{\overset{\oplus}{N}}—\underset{\underset{R_{15}}{|}}{}Alk—SO_3^{\ominus}$$

(wherein Alk represents a lower alkylene group having 1 to 5 carbon atoms such as a methylene group, an ethylene group, a propylene group, and a butylene group; $R_{14}$ and $R_{15}$ each represents an unsubstituted or substituted alkyl group having 1 to 8 carbon atoms or an aryl group, such as a methyl group, an ethyl group, a benzyl group) and a hydrophilic cation group such as $$—\overset{\overset{R_{14}}{|}}{\overset{\oplus}{N}}—\underset{\underset{R_{16}}{|}}{}R_{15}.Y^{\ominus}$$

(wherein $R_{14}$, $R_{15}$, and $R_{16}$ have the same meaning as $R_{14}$ described above and $Y^{\ominus}$ represents an anion and represents a hydroxy group, a halogen atom, a sulfuric acid group, a carbonic acid group, a perchloric acid group, an organic carboxylic acid group, an organic sulfonic acid group, an organic sulfuric acid group); and X is preferably a hydrophilic anion group such as $—SO_3M$, $—OSO_3M$, —COOM, $$—O—\overset{\overset{O}{\|}}{P}(OM)_2—O—\overset{\overset{O}{\|}}{P}—OM$$
$$\qquad\qquad\qquad\qquad\qquad\qquad\quad \underset{\underset{O—B—Rf}{|}}{}$$

(wherein M represents an inorganic or organic cation such as, preferably a hydrogen atom, an alkali metal, an alkaline earth metal, an ammonium group, a lower alkylamine group; and B and Rf have the same meaning as defined above).

Examples of the fluorine-containing compound for use in this invention are illustrated below.

$C_7F_{15}COOH$ II-1

$H(CF_2)_8CH_2COONH_4$ II-2

$C_8F_{17}SO_3K$ II-3

$$C_8F_{17}SO_2\overset{\overset{C_3H_7}{|}}{N}—CH_2COOK$$ II-4

$H(CF_2)_6COOCH_2CH_2CH_2SO_3Na$ II-5

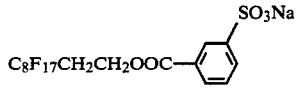

II-6

$$C_7F_{15}CO\overset{\overset{CH_3}{|}}{N}—CH_2CH_2SO_3Na$$ II-7

$$H(CF_2)_6CH_2OOC—\underset{\underset{H(CF_2)_6CH_2OOC—CH—SO_3Na}{|}}{CH_2}$$ II-8

$$H(CF_2)_8CH_2O(CH_2CH_2O)_pOC—\underset{\underset{H(CF_2)_8CH_2O(CH_2CH_2O)_pOC—CH—CH_2SO_3K}{|}}{CH_2}$$ II-9

$p$: mean 3

$$C_8F_{17}SO_2\overset{\overset{C_3H_7}{|}}{N}(CH_2CH_2O)_p(CH_2)_4SO_3Na$$ II-10

$p$: mean 4

$$C_8F_{17}SO_2\overset{\overset{C_3H_7}{|}}{N}(CH_2CH_2O)_p(CH_2)_5SO_3Na$$ II-11

$p$: mean 7

$C_{10}F_{21}CH_2CH_2O(CH_2CH_2O)_p(CH_2)_4SO_3Na$ II-12

$p$: mean 6

$$C_8F_{17}SO_2\overset{\overset{C_3H_7}{|}}{N}—CH_2CH_2O—\overset{\overset{O}{\|}}{P}—ONa$$
$$\qquad\qquad\qquad\qquad\qquad\qquad\qquad\quad \underset{\underset{ONa}{|}}{}$$ II-13

$$\left[C_8F_{17}SO_2\overset{\overset{C_3H_7}{|}}{N}(CH_2CH_2O)\right]_2\overset{\overset{O}{\|}}{P}—ONa$$ II-14

$p$: mean 5

-continued
II-15
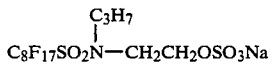
II-16
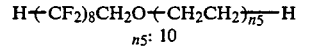
$n_5$: 10
II-17
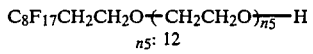
$n_5$: 12
II-18
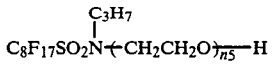
$n_5$: 11
II-19
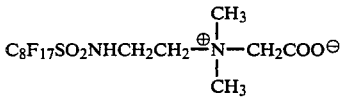
II-20
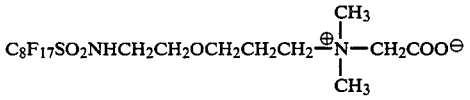
II-21
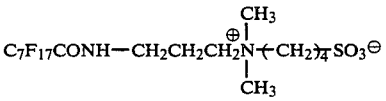
II-22
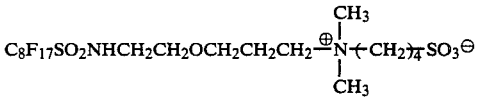
II-23
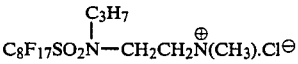
II-24
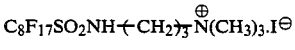
II-25
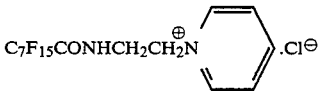
II-26
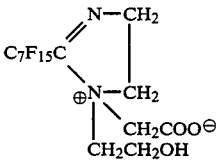
II-27
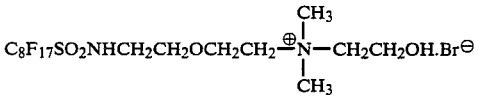
II-28
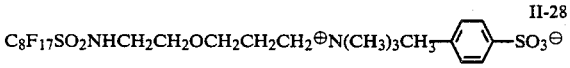
II-29
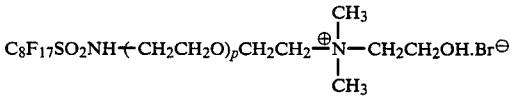
$p$: mean 4
II-30
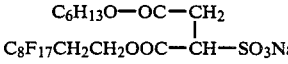
-continued
II-31
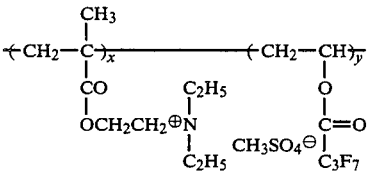
$x:y$ = 80:20 (The ratio is hereinafter "molar ratio")
II-32
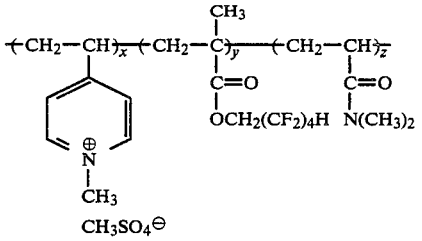
$x:y:z$ = 70:20:10
II-33
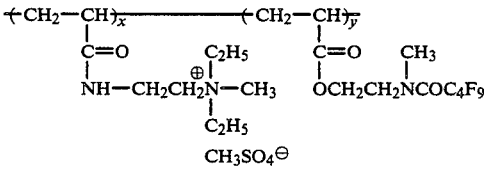
$x:y$ = 65:35
II-34
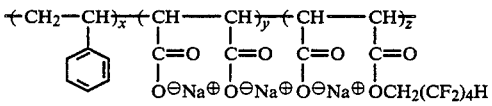
$x:y:z$ = 50:30:20
II-35
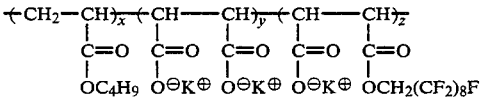
$x:y:z$ = 50:20:30
II-36
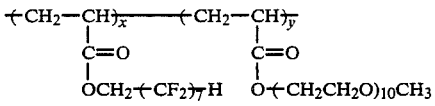
$x:y$ = 40:60
II-37
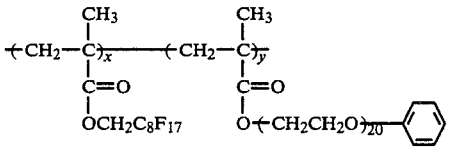
$x:y$ = 70:30
II-38
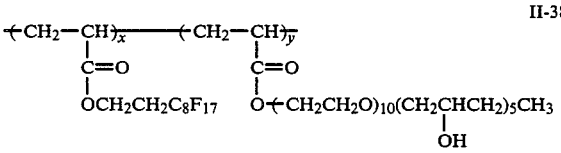
$x:y$ = 50:50
II-39
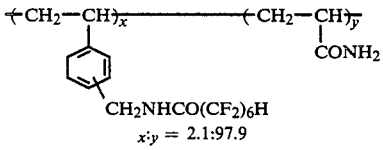
$x:y$ = 2.1:97.9

-continued

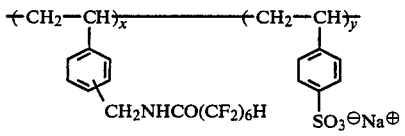

II-40

$x:y = 35:65$

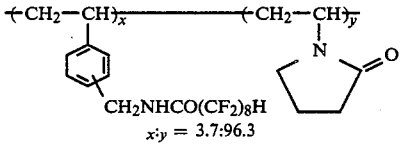

II-41

$x:y = 3.7:96.3$

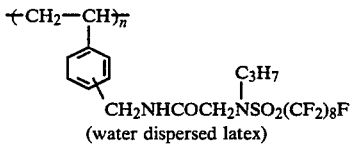

II-42

(water dispersed latex)

The amount of the florine-containing compound which is used in this invention is generally 0.1 mg to 1 g, in particular 0.5 to 300 mg per square meter of the photographic material. The nonionic surface active agent and the fluorine-containing compound in this invention may be incorporated in any hydrophilic colloid layer of a photographic material without any restriction but it is preferred to incorporate them in a surface protective layer or a surface layer at the back side of the photographic material.

The measurement of the element composition on the surface of a photographic material by an X-ray photoelectron spectrometry is performed using a Mg-K$\alpha$ ray as an X-ray source for excitation by detecting photoelectrons in the direction perpendicular to the surface of a sample under a vacuum of lower than $5\times10^{-5}$ Pa.

The detection of the $C_{ls}$ electron is performed by measuring at a scanning speed below 0.2 ev./sec. in the bonding energy range of 300 ev. to 270 ev. The detection of the $F_{ls}$ electron is performed by measuring at a scanning speed below 0.2 ev./sec. in a bonding energy range of 700 ev. to 680 ev. In this case, since the signal of the $F_{ls}$ electron rapidly decreases by the irradiation of exciting X-ray, it is necessary, if desired, to control the range of scanning so that the requiring time from the initiation of the irradiation of X-ray to the end of the measurement of the $F_{ls}$ peak dose not exceed 50 seconds. The peak intensity can be obtained by measuring the interval from the base line to the maximum value of the peak.

The ratio of the $F_{ls}$ peak intensity/$C_{ls}$ peak intensity obtained by the method indicates the ratio of fluorine and carbon near the surface of the sample.

The other constitution of the photographic material of this invention is briefly described below.

The form of silver halide grains which are used in the silver halide photographic emulsions may be a regular crystal form, such as a cubic form or a tetrahedral form, or an irregular crystal form such as a pherical form and a tabular form, or further may be a composite of these crystal forms. Also, the silver halide grains may be composed of a mixture of silver halide grains having various different crystal forms.

These silver halide photographic emulsions can be prepared by the methods described in P. Glafkides, *Chimie et Physique Photographique* (published by Paul Montel Co., 1967); G. F. Duffin, *Photographic Emulsion Chemistry* (published by Focal Press, 1966); V. L. Zelikman et al., *Making and Coating Photographic Emulsion* (published by The Focal Press, 1964). That is, the photographic emulsions may be prepared by an acid method, a neutralization method, an ammonia method, etc. Also, a water-soluble silver salt and a water-soluble halide may be reacted by a single jet mixing method, a double jet mixing method, or a combination of these methods.

As the binder for the photographic layers in this invention, there are proteins such as gelatin, casein; cellulose compounds such as carboxymethyl cellulose, hydroxyethyl cellulose; sucrose derivatives such as agar agar, sodium alginate, a starch derivative; synthetic hydrophilic colloids such as polyvinyl alcohol, poly-N-vinylpyrrolidone, a polyacrylic acid copolymer, polyacrylamide, and the derivatives or partially hydrolyzed products of the aforesaid hydrophillic colloids; and the mixture thereof.

Gelatin which is used as a binder in this invention includes so-called lime-processed gelatin, acid-processed gelatin and enzyme-processed gelatin.

Also, the photographic materials of this invention can contain in the photographic layers the alkyl acrylate series latexes described in U.S. Pat. Nos. 3,411,911, 3,411,912; Japanese patent publication No. 5331/70.

The silver halide emulsions may be used as so-called primitive emulsions, i.e., without being chemically sensitized but are usually chemically sensitized. For the chemical sensitization, the methods described in P. Glafkides, *Chimie et Physique Photographique* (Paul Montel, 1967); V. L. Zelikman et al., *Making and Coating Photographic Emulsion* (The Focal Press, 1964); and H. Frieser, *Die Grundlagen Der Photographischen Prozesse mit Silverhalogeniden* (Akademische Verlagsgesellschaft, 1968).

That is, the chemical sensitization can be performed by a sulfur sensitization method using a compound containing sulfur capable of reacting with a silver ion or active gelatin, a reduction sensitization method using a reducing substance, a noble metal sensitization method using a compound of gold or other noble metal, or a combination of these methods.

As a sulfur sensitizer, there are thiosulfates, thioureas, thiazoles, rhodanines, etc., and practical examples of these sensitizers are described in, for example, U.S. Pat. Nos. 1,574,944, 2,410,689, 2,278,947, 2,728,668, 3,656,955. Also, as a reduction sensitizer, there are stannous salts, amines, hydrazine derivatives, formamidinesulfinic acid, silane compounds, etc.

The photographic materials of this invention can further contain various compounds as antifoggant or a stabilizer. That is, there are azoles such as benzothiazolium salts, nitroindazoles, triazoles, benzotriazoles, benzimidazoles (in particular, the nitro- or halogen-substitution product thereof); heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole), and mercaptopyridines; the aforesaid heterocyclic mercapto compounds having a water solubilizing group such as a carboxy group and a sulfo group; thioketo compounds such as oxazolinethion, etc.; azaindenes such as tetraazaindenes (in particular 4-hydroxy-substituted (1,3,3a,7)tetraazaindenes); benzenethiosulfonic acids; benzenesulfinic acid; which are known as antifoggants or stabilizers.

Practical examples and the methods of using these compounds are described in, for example, U.S. Pat. Nos. 3,954,474, 3,982,947, and 4,021,248; Japanese patent publication No. 28660/77.

Examples of the hardening agents for the photographic layers of the photographic materials are aldehyde compounds such as mucochloric acid, mucobromic acid, mucophenoxychloric acid, mucophenoxybromic acid, formaldehyde, dimethylolurea, trimethylolmelamine, glyoxal, monomethylglyoxal, 2,3-dihydroxy-1,4-dioxane, 2,3-dihydroxy-5-methyl-1,4-dioxane, succinaldehyde, 2,5-dimethoxytetrahydrofuran, glutaraldehyde; active vinyl compounds such as divinylsulfone, methylenebismaleimide, 5-acetyl-1,3-diacryloyl-hexahydro-s-triazine, 1,3,5-triacryloyl-hexahydro-s-triazine, 1,3,5-trivinylsulfonyl-hexahydro-s-triazine, bis(vinylsulfonylmethyl) ether, 1,3-bis(vinylsulfonylmethyl)propanol-2, bis(α-vinylsulfonylacetamido)ethane; active halogen compounds such as 2,4-dichloro-6-hydroxy-s-triazine.sodium salt, 2,4-dichloro-6-methoxy-s-triazine, 2,4-dichloro-6-(4-sulfoanilino)-s-triazine.sodium salt, 2,4-dichloro-6-(2-sulfoethylamino)-s-triazine, N,N'-bis(2-chloroethylcarbamyl)piperidine; epoxy compounds such as bis(2,3-epoxypropyl)methylpropyl ammonium.p-toluenesulfonate, 1,4-bis(2',3'-epoxypropyloxy)butane, 1,3,5-triglycidyl isocyanurate, 1,3-diglycidyl-5-(γ-acetoxy-β-oxypropyl) isocyanurate; ethyleneimine compounds such as 2,4,6-triethyleneimino-s-triazine, 1,6-hexamethylene-N,N'-bisethyleneurea, bis-β-ethyleneiminoethyl thioether; methanesulfonic acid esters such as 1,2-di(methanesulfonoxy)ethane, 1,4-di(methanesulfonoxy)butane, 1,5-di(methanesulfonoxy)pentane; carbodiimide compounds, isooxazole compounds; and inorganic compounds such as chromium alum.

The photographic materials of this invention may further contain in the silver halide photographic emulsion layers or other layers other surface active agents than those described herein for various purposes, for example, for coating aid, static prevention, improvement of sliding property, emulsification dispersion, adhesion prevention, and improvement of photographic properties (e.g., acceleration of development, improvement of contrast, sensitization).

Examples of such surface active agents are nonionic surface active agents such as saponin; anionic surface active agents containing an acid group as a carboxy group, a sulfo group, a phospho group, a sulfuric ester group, a phosphoric acid ester, such as alkyl carboxylates, alkylsulfonates, alkylbenzenesulfonates, alkylnaphthalenesulfonates, alkylsulfuric acid esters, alkylphosphoric acid esters, N-acyl-N-alkyltaurine, sulfosuccinic acid esters, sulfoalkyl polyoxyethylenealkylphenyl ethers, polyoxyethylene alkylphosphoric acid esters; amphoteric surface active agents such as amino acids, aminoalkylsulfonic acids, aminoalkylsulfuric acid esters, aminoalkylphosphoric acid esters, alkylbetaines, amine oxides; and cationic surface active agents such as alkylamine salts, aliphatic or aromatic quaternary ammonium salts, heterocyclic quaternary ammonium salts such as pyridinium, imidazolium, phosphonium salts or sulfonium salts containing aliphatic rings or heterocyclic rings.

The following examples are provided for illustrating purposes and are in no way intended to limit the scope of the present invention.

EXAMPLE 1

(1) Preparation of sample:

Each sample of black-and-white silver halide photographic materials was prepared by coating a silver halide emulsion layer having the composition described below on a polyethylene terephthalate film support of 180 microns in thickness having a subbing layer and further coating thereon a protective layer having the composition shown below followed by drying.

Silver halide emulsion layer:

Thickness: about 5 microns.

Composition:

To a gelatino silver iodobromide emulsion (mean grain size of the silver halide grains being 1.3 microns) containing 1.5 mol % silver iodide were added 0.6 mg of chloroauric acid and 3.4 mg of sodium thiosulfate per mole of the silver halide and then the emulsion was ripened for 50 minutes at 60° C. Then, 4-hydroxy-6-methyl-1,3,3a,7-tetraazaindene was added to the silver halide emulsion as a stabilizer.

Protective layer:

Thickness: about 1 micron.

Composition and coating amount:

| | |
|---|---|
| Gelatin | 1.5 g/m$^2$ |
| 2,6-Dichloro-6-hydroxy-1,3,5-triazine sodium salt | 10 mg/m$^2$ |
| Sodium dodecylsulfate | 10 mg/m$^2$ |

The amount of general formula (I-1), (I-2) or (I-3) shown in Table 1.

(2) Establishment of drying condition:

Drying condition A:

$\Delta t = t_D - t_W$ = dry-bulb temperature of drying air-wet-bulb temperature of drying air. When $\Delta t$ is defined as described above, $\Delta t = 10°$ C.

Drying condition B:

$\Delta t = 16°$ C.

(3) Measurement method for element composition on the surface of photographic material:

The element composition was measured by the method described above using an ESCA 750 type X-ray photoelectron spectrometer made by Shimazu Corporation.

(4) Evaluation method of antistatic property:

The antistatic property was determined by the measurement of the occurrence of static marks. The test for the occurrence of static marks was performed by placing the surface of each unexposed photographic material containing antistatic agents on a urethane rubber sheet, a neoprene rubber sheet, a nylon resin plate, or High Screen (standard) made by Kasei Optonics Co. in face to face relation, while pressing on the photographic material with a rubber roller and then peeling off the photographic material.

The test for the occurrence of static marks was performed at 25° C. and 25% RH. In addition, the humidification of the test sample was performed for a whole day and night under the above-described condition.

The evaluation of static marks was made according to the standard of the following five steps.

A: The occurrence of static marks is not observed.

B: Static marks occur a little.

C: Static marks occur considerably.

D: Static marks greatly occur.

E: Static marks occur on the entire surface.

(5) Development process:

For determining the extent of the occurrence of static marks, each sample was developed for 90 seconds using RD-III (made by Fuji Photo Film Co.) as a developer by means of an automatic developing machine, Fuji RN (made by Fuji Photo Film Co.).

The results thus obtained are shown in Table 1.

TABLE 1

| Sample No. | Compound of Formula (II) Kind | Compound of Formula (II) Amount ($mg/m^2$) | Compound of Formula (I) Kind | Compound of Formula (I) Amount ($mg/m^2$) | Coating Aid Kind | Coating Aid Amount ($mg/m^2$) | Drying Cond. | $F_{ls}/C_{ls}$** | Occurrence of Static Marks (a) | (b) | (c) | (d) |
|---|---|---|---|---|---|---|---|---|---|---|---|---|
| 1* | II-5 | 0.6 | I-31 | 60 | Compound A | 25 | A | 0.25 | E | C | A | C |
| 2 | " | 2.0 | " | " | " | " | " | 0.8 | A | A | A | A |
| 3 | " | 4.2 | " | " | " | " | " | 1.5 | A | A | A | A |
| 4* | " | 6.0 | " | " | " | " | " | 2.5 | A | C | E | A |
| 5* | " | 2.0 | " | " | " | " | B | 0.2 | E | E | B | D |
| 6* | " | 2.5 | I-6 | 70 | " | 30 | A | 0.25 | E | D | A | C |
| 7 | " | " | " | 35 | " | " | " | 1.0 | A | A | A | A |
| 8* | II-8 | 1.8 | I-31 | 60 | " | 25 | " | 0.15 | E | E | B | E |
| 9 | " | 8.5 | " | " | " | " | " | 1.0 | A | A | A | A |
| 10* | " | 25.0 | " | " | " | " | " | 3.0 | D | E | E | A |
| 11 | " | 12.5 | " | " | Compound B | 15 | " | 1.5 | A | A | A | A |
| 12* | " | " | " | " | " | 10 | " | 2.5 | C | D | E | A |
| 13* | " | " | I-23 | 90 | Compound A | 15 | " | 0.1 | D | D | C | E |
| 14 | " | " | " | 45 | " | " | " | 0.8 | A | A | A | A |

(*): Comparison Sample; No marked sample: Sample of this invention
(**): $F_{ls}$ peak intensity/$C_{ls}$ peak intensity
(a): Urethane rubber;
(b): Neoprene rubber;
(c): Nylon;
(d): Screen The coating aids used in the above experiments were as follows:

Compound A

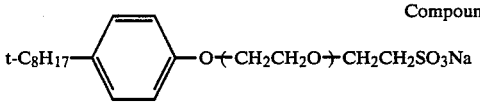

Compound B

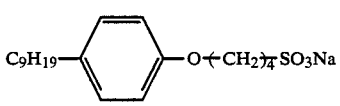

From the results on Sample Nos. 1 to 4, and 8 to 10 shown in Table 1 above, it can be seen that the ratio of $F_{ls}/C_{ls}$ increases with the increase of the amount of the fluorine-containing surface active agent.

Also, it can be seen from the results on Sample Nos. 6, 7, 13 and 14 that the ratio of $F_{ls}/C_{ls}$ changes by the amount and kind of the nonionic surface active agent having a polyoxyethylene group. Further, it can be seen from the results on Sample Nos. 11 and 12 that the ratio changes by the kind and amount of the coating aid.

It can be also seen from the results on Sample Nos. 2 and 5 that when the materials to be added and the amounts of them are same, the ratio of $F_{ls}/C_{ls}$ changes by changing the drying method.

As described above, the ratio of $F_{ls}/C_{ls}$ changes according to the kinds and amounts of the fluorine-containing surfce active agent, the nonionic surface active agent having a polyoxyethylene group, and the coating aid, and also the drying condition. However, the samples causing no static marks for various additives are only the samples in which the ratio of $F_{1s}/C_{1s}$ is in the range of 0.3 to 2.0.

EXAMPLE 2

(1) Preparation of samples:

Each of black-and-white silver halide photographic materials was prepared by coating, in succession, silver halide emulsion A and silver halide emulsion B having the compositions shown below on a polyethylene terephthalate film support of 180 microns in thickness having a subbing layer and further coating a protective layer having the composition shown below followed by drying.

Silver halide emulsion layer:

Composition and coating amount:

Silver halide emulsion A was prepared by adding to a gelatino silver iodobromide emulsion (the mean grain size of the silver halide grains being 1.0 micron) containing 1.5 mole % silver iodide 0.6 mg of chloroauric acid and 3.4 mg of sodium thiosulfate per mole of the silver halide and performing ripening the emulsion for 55 minutes at 60° C. Silver halide emulsion B was prepared by adding to a gelatino silver iodobromide emulsion (the mean grain size of the silver halide grains being 1.3 microns) containing 1.5 mole % silver iodide 0.6 mg of chloroauric acid and 3.4 mg of sodium thiosulfate per mole of the silver halide and then ripening the emulsion for 50 minutes at 60° C., in the same manner as in Silver halide emulsion A. To each of the silver halide emulsions thus prepared were added 4-hydroxy-6-methyl-1,3,3*a*,7-tetraazaindene as a stabilizer and further $1\times10^{-4}$ mole/mole-Ag of Compound (a) shown below.

When the relative sensitivity of Silver halide emulsion A thus obtained was defined to be 60, the relative sensitivity of silver halide emulsion B was 100.

The coated amount of silver of each of the samples thus obtained as described above was 1.3 $g/m^2$ for the emulsion A layer and 2.6 $g/m^2$ for the emulsion B layer. The coated amount of gelatin was 0.8 $g/m^2$ for the emulsion A layer and 1.6 $g/m^2$ for the emulsion B layer.

Compound (a)

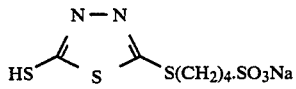

Protective layer:

Thickness: about 1 micron

Composition and coating amount:

| | |
|---|---|
| Gelatin | 1.5 g/m$^2$ |
| 2,6-Dichloro-6-hydroxy-1,3,5-triazine sodium salt | 10 mg/m$^2$ |
| Sodium dodecylsulfate | 10 mg/m$^2$ |

The compound shown by general formula (I-1), (I-2), (I-3) or (II) as shown in Table 2.

(2) Establishment of drying condition: same as in Example 1.

(3) Measurement method for element composition on the surface of the photographic material: same as in Example 1.

(4) Evaluation method of antistatic property: same as in Example 1.

(5) Development process: same as in Example 1.

(6) Measurement method of stained extent of intensifying screen:

Each sample and an intensifying screen, LT-II, made by Dai Nippon Toryo Co. were humidified for one day at 30° C. and 80% RH, after passing 100 samples through a cassette using the screen, LT-II under a same condition, X-ray photographing was performed, and then for formation of uneven density was observed.

The evaluation of the stained degree of the intesifying screen was made by the standard of the following four stages.

A: The formation of uneven density is not observed.

B: Uneven density forms a little. C: Uneven density forms considerably.

D: Uneven density greatly forms.

The results thus obtained are shown in Table 2.

TABLE 2

| Sample No. | Amount of Compound II-18 (mg/m$^2$) | Compound of formula (I) Kind | Compound of formula (I) Amount (mg/m$^2$) | Amount of Coating Aid A (mg/m$^2$) | $F_{1s}/C_{1s}$ | Occurrence of Static Marks (a) | (b) | (c) | (d) | (e) | (f) |
|---|---|---|---|---|---|---|---|---|---|---|---|
| 1 | 6.0 | I-10 | 35 | 10 | 1.1 | A | A | A | A | D | 90 |
| 2 | 6.0 | I-60 | 35 | 15 | 1.0 | A | A | A | A | D | 90 |
| 3 | 12.5 | I-25 | 45 | 15 | 1.6 | A | A | A | A | B | 95 |
| 4 | 8.5 | I-31 | 60 | 25 | 1.0 | A | A | A | A | A | 98 |
| 5* | 0 | — | — | 15 | 0 | E | E | E | E | A | 100 |

(*): Comparison Sample; No marked sample: Sample of this invention $F_{1s}/C_{1s}$: $F_{1s}$ peak intensity/$C_{1s}$ peak intensity (a): Urethane rubber;

(b): Neoprene rubber;

(c): Nylon;

(d): Screen;

(e): Stained degree of screen;

(f): Relative sensitivity

From the results on Sample Nos. 1 to 4 shown in Table 2, it can be seen that when the ratio of $F_{1s}/C_{1s}$ is in the range of 0.3 to 2.0, static marks do not occur for various additives regardless of the kind of the nonionic surface active agent having a polyoxyethylene group.

On the other hand, the stained degree of the intensifying screen and the relative sensitivity change according to the kind of the nonionic surface active agent having a polyoxyethylene group and there is a tendency that the compound shown by general formula (I-3) has the best property and the property becomes lower to some extent in the order of the compound shown by formula (I-2) and the compound shown by formula (I-1).

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one layer containing a nonionic surface active agent having a polyoxyethylene group and a fluorine-containing surface active compound, wherein the element composition of the surface of said layer has a ratio of $F_{1s}$ peak intensity/$C_{1s}$ peak intensity in the range of 0.3 to 2.0 when measured by an X-ray photoelectron spectrometry.

2. The silver halide photographic material as claimed in claim 1, wherein said layer containing the nonionic surface active agent and the fluorine-containing surface active compound is a surface protective layer.

3. The silver halide photographic material as claimed in claim 1, wherein said layer containing the nonionic surface active agent and the fluorine-containing surface active compound is a backing layer.

4. The silver halide photographic material as claimed in claim 1, wherein the nonionic surface active agent is a compound represented by the general formula $$R_1—A—CH_2CH_2O)_{di\ n\ 1}H$$

wherein $R_1$ represents an unsubstituted or substituted alkyl group having 1 to 30 carbon atoms, an unsubstituted or substituted alkenyl group, or an unsubstituted or substituted aryl group; A represents —O— group, —S— group, —COO— group, $$-\underset{|}{N}-R_{10}\text{ group},\ -CO-\underset{|}{N}-R_{10}\text{ group, or }-SO_2\underset{|}{N}-R_{10}\text{ group}$$

(wherein $R_{10}$ represents a hydrogen atom or an unsubstituted or substituted alkyl group), and $n_1$ represents a number of 2 to 50.

5. The silver halide photographic material as claimed in claim 1, wherein the nonionic surface active agent is a compound represented by the general formula

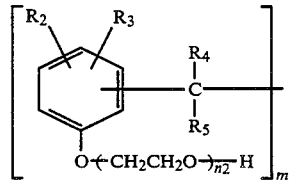

wherein $R_2$ and $R_3$ each represents a hydrogen atom, an unsubstituted or substituted alkyl group, an aryl group, an alkoxy group, a halogen atom, an acyl group, an amido group, a sulfonamido group, a carbamoyl group, or a sulfamoyl group; $R_4$ and $R_5$ each represents a hydrogen atom, an unsubstituted or substituted alkyl group or an aryl group, said $R_4$ and $R_5$ may combine with each other to form an unsubstituted or substituted ring; $n_2$ represents a number of 2 to 50, and m represents a number of 2 to 50.

6. The silver halide photographic material as claimed in claim 1, wherein the nonionic surface active agent is a compound represented by the general formula

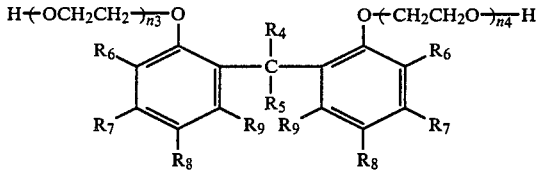

wherein $R_4$ and $R_5$ each represents a hydrogen atom, an unsubstituted or substituted alkyl group, or an aryl group; said $R_4$ and $R_5$ may combine with each other to form an unsubstituted or substituted ring; $R_6$ and $R_8$ represents an unsubstituted or substituted alkyl group, and aryl group, an alkoxy group, a halogen atom, an acyl group, an amido group, a sulfonamido group, a carbamoyl group or a sulfamoyl group; $R_7$ and $R_9$ each represents a hydrogen atom, an unsubstituted or substituted alkyl group, an aryl group, an alkoxy group, a halogen atom, an acyl group, an amido group, a sulfonamido group, a carbamoyl group, or a sulfamoyl group; said $R_6$ and $R_7$ and said $R_8$ and $R_9$ may combine with each other to form an unsubstituted or substituted ring; and $n_3$ and $n_4$ each represents a number of 2 to 50.

7. The silver halide photographic material as claimed in claim 1, wherein the fluorine-containing surface active compound is a fluorine-containing surface active agent represented by the general formula Rf—B—X wherein Rf represents a partially or wholly fluorinated unsubstituted or substituted alkyl, alkenyl or aryl group containing at least three fluorine atoms; B represents a divalent linkage group, and X represents a water-solubilizing group.

8. The silver halide photographic material as claimed in claim 1, wherein said nonionic surface active agent is employed in an amount of from 5 to 500 milligrams per square meter of the photographic material.

9. The silver halide photographic material as claimed in claim 8, wherein said nonionic surface active agent is employed in an amount of from 10 to 300 milligrams per square meter of the photographic material.

10. The silver halide photographic material as claimed in claim 1, wherein said fluorine-containing surface active compound is employed in an amount of from 0.1 milligrams to 1 gram per square meter of the photographic material.

11. The silver halide photographic material as claimed in claim 10, wherein said fluorine-containing surface active compound is employed in an amount of from 0.5 to 300 milligrams per square meter of the photographic material.

12. The silver halide photographic material as claimed in claim 1, wherein said ratio of $F_{1s}$ peak intensity/$C_{1s}$ peak intensity is in the range of from 0.8 to 1.6 when measured by an X-ray photoelectron spectrometry.

13. The silver halide photographic material as claimed in claim 1, wherein said fluorine-containing suface active compound is a polymer or a surface active agent.

* * * * *

UNITED STATES PATENT AND TRADEMARK OFFICE

CERTIFICATE OF CORRECTION

PATENT NO. : 4,596,766

DATED : June 24, 1986

INVENTOR(S) : Ryoichi Nemori et al

It is certified that error appears in the above-identified patent and that said Letters Patent is hereby corrected as shown below:

Under the heading "[30] Foreign Application Priority Data", please delete "188230" and substitute therefor -- 58/188230 --.

Signed and Sealed this

Tenth Day of March, 1987

*Attest:*

DONALD J. QUIGG

*Attesting Officer*

*Commissioner of Patents and Trademarks*